US008937584B2

(12) United States Patent
Kwak et al.

(10) Patent No.: US 8,937,584 B2
(45) Date of Patent: Jan. 20, 2015

(54) ORGANIC LIGHT EMITTING DISPLAY AND MOTHER SUBSTRATE THEREOF

(75) Inventors: Won-Kyu Kwak, Yongin (KR); Dong-Wook Park, Yongin (KR); Hae-Jin Chun, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 1080 days.

(21) Appl. No.: 12/791,225

(22) Filed: Jun. 1, 2010

(65) Prior Publication Data

US 2011/0043500 A1 Feb. 24, 2011

(30) Foreign Application Priority Data

Aug. 20, 2009 (KR) ..... 10-2009-0077047

(51) Int. Cl.

| | |
|---|---|
| ***G09G 3/30*** | (2006.01) |
| ***G09G 3/32*** | (2006.01) |
| ***G09G 3/34*** | (2006.01) |
| ***G09G 3/36*** | (2006.01) |
| ***G09G 3/00*** | (2006.01) |

(52) U.S. Cl.

CPC ..... *G09G 3/006* (2013.01); *G09G 3/3208* (2013.01); *G09G 2300/0452* (2013.01); *G09G 2320/0223* (2013.01)

USPC ..... 345/80; 345/81; 345/82; 345/83

(58) Field of Classification Search

None

See application file for complete search history.

(56) References Cited

U.S. PATENT DOCUMENTS

| | | | | |
|---|---|---|---|---|
| 7,205,713 | B2 * | 4/2007 | Kiguchi | 313/504 |
| 2005/0184940 | A1 * | 8/2005 | Oh et al. | 345/87 |
| 2006/0114190 | A1 * | 6/2006 | Fang et al. | 345/76 |
| 2008/0068309 | A1 * | 3/2008 | Kwak et al. | 345/82 |
| 2009/0213054 | A1 * | 8/2009 | Masui | 345/88 |

FOREIGN PATENT DOCUMENTS

| | | |
|---|---|---|
| JP | 2003-308051 | 10/2003 |
| JP | 2008-146957 | 6/2008 |
| KR | 1020030051923 A | 6/2003 |
| KR | 1020050003255 A | 1/2005 |

OTHER PUBLICATIONS

Japanese Office action dated Jan. 20, 2011 issued to corresponding Korean priority application No. 10-2009-0077047, listing the cited reference in this IDS, 2 pages.

* cited by examiner

*Primary Examiner* — Amr Awad
*Assistant Examiner* — Andre Matthews
(74) *Attorney, Agent, or Firm* — Christie, Parker & Hale, LLP

(57) ABSTRACT

An organic light emitting display includes a display unit that includes scan lines and data lines. First sub-pixels, second sub-pixels, and third sub-pixels that emit light corresponding to different colors are repeatedly arranged in a uniform pattern. The organic light emitting display also includes a scan driver for supplying scan signals to the scan lines; a data driver coupled to one end of each of the data lines for supplying data signals to the data lines; a switch unit coupled between the one end of each of the data lines and the data driver to transmit the data signals supplied from output lines of the data driver to the data lines; and a test circuit unit including transistors coupled to other ends of the data lines. The first sub-pixels and the second sub-pixels are alternately arranged in same columns and the third sub-pixels are arranged in columns adjacent to the same columns.

20 Claims, 4 Drawing Sheets

ORGANIC LIGHT EMITTING DISPLAY AND MOTHER SUBSTRATE THEREOF

CROSS-REFERENCE TO RELATED APPLICATION

This application claims priority to and the benefit of Korean Patent Application No. 10-2009-0077047, filed on Aug. 20, 2009, in the Korean Intellectual Property Office, the entire content of which is incorporated herein by reference.

BACKGROUND

1. Field

The described technology relates to an organic light emitting display and a mother substrate thereof.

2. Description of the Related Art

An organic light emitting display displays an image using organic light emitting diodes (OLEDs) that are self-emission elements. The organic light emitting display has high brightness and chromatic purity so that the organic light emitting display is in the spotlight as a next generation display.

However, when sheet unit testing a mother substrate containing several high resolution organic light emitting display panels, where pixels of two colors share the same columns and data lines within the panels, problems (such as voltage drop and signal delay) can result when supplying pulse-shaped alternating current (AC) signals along the relatively long sheet wiring lines that span the mother substrate and that are used to drive the common data lines of the two colors.

SUMMARY

Embodiments of the present invention provide an organic light emitting display capable of effectively perform a sheet unit test while adopting a pixel arrange structure of displaying an image of high resolution and a mother substrate thereof.

According to an exemplary embodiment of the present invention, an organic light emitting display is provided. The organic light emitting display includes a display unit, a scan driver, a data driver, a switch unit, and a test circuit unit. The display unit includes first sub-pixels, second sub-pixels, and third sub-pixels for emitting light corresponding to different colors that are located at crossing regions of scan lines and data lines. The scan driver is for supplying scan signals to the scan lines. The data driver is coupled to one end of each of the data lines for supplying data signals to the data lines. The switch unit is coupled between the one end of each of the data lines and the data driver to transmit the data signals supplied from output lines of the data driver to the data lines. The test circuit unit includes a plurality of transistors coupled to other ends of the data lines. The first sub-pixels and the second sub-pixels are alternately arranged in same columns and the third sub-pixels are arranged in columns adjacent to the same columns. In the same columns, first data lines of the data lines coupled to the first sub-pixels in each column are separated from second data lines of the data lines coupled to the second sub-pixels. The first data lines and the second data lines in the same columns are coupled to different transistors included in the test circuit unit and are coupled by the switch unit to same output lines among the output lines of the data driver.

According to another exemplary embodiment of the present invention, a mother substrate is provided. The mother substrate includes a plurality of organic light emitting display panels, a first wiring line group, and a second wiring line group. The plurality of organic light emitting display panels are arranged in a matrix. The first wiring line group includes a plurality of wiring lines at a region external to the organic light emitting display panels in a first direction for transmitting test power or external signals to the plurality of organic light emitting display panels in a same panel column. The second wiring line group includes a plurality of wiring lines at a region external to the organic light emitting display panels in a second direction that crosses the first direction for transmitting other test power or external signals to the plurality of organic light emitting display panels in a same panel row. Each of the organic light emitting display panels includes a display unit, a scan driver, a switch unit, and a test circuit unit. The display unit includes first sub-pixels, second sub-pixels, and third sub-pixels for emitting light corresponding to different colors that are located at crossing regions of scan lines and data lines. The scan driver is for supplying scan signals to the scan lines. The switch unit includes a plurality of switches coupled to one end of each of the data lines. The test circuit unit includes a plurality of transistors coupled to other ends of the data lines. The first sub-pixels and the second sub-pixels are alternately arranged in same columns and the third sub-pixels are arranged in columns adjacent to the same columns. In the same columns, first data lines of the data lines coupled to the first sub-pixels in each column are separated from second data lines of the data lines coupled to the second sub-pixels. The first data lines and the second data lines in the same columns are coupled to different signal lines included in the first or the second wiring line group by different transistors included in the test circuit unit.

As described above, according to embodiments of the present invention, when a pixel arrangement structure of high resolution, in which the first sub-pixels and the second sub-pixels are alternately arranged in the same columns, is adopted, the data lines of the first sub-pixels are separated from the data lines of the second sub-pixels so that the test signals and the test control signals are supplied in the form of direct current (DC). Therefore, the sheet unit test may be effectively performed.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
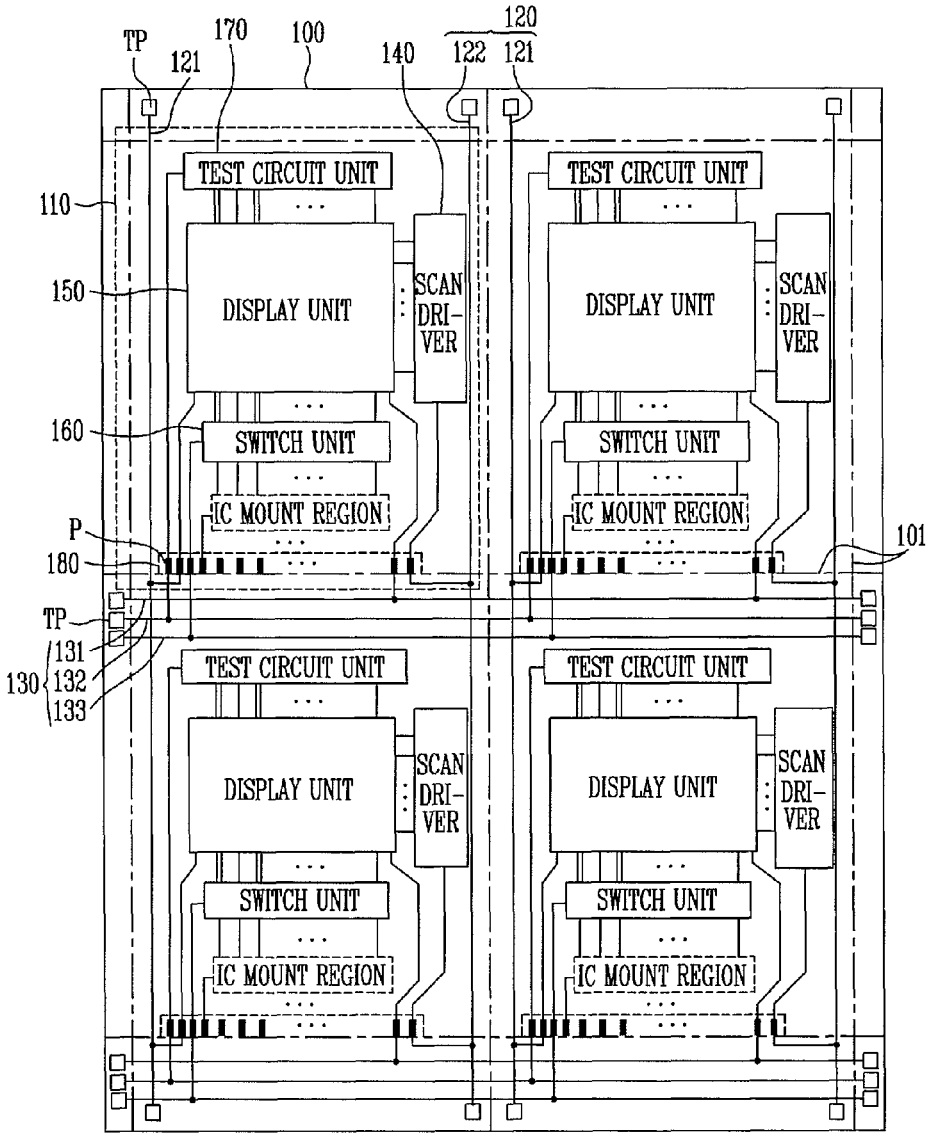
FIG. 1 is a schematic plan view illustrating a mother substrate of organic light emitting displays according to an embodiment of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Hereinafter, embodiments of the present invention will be described in detail with reference to the accompanying drawings.

In the organic light emitting display, a plurality of pixels includes red sub-pixels, green sub-pixels, and blue sub-pixels to display an image of various colors. When a human eye senses a color, it is affected by a process referred to as assimilation or the Von Bezold color mixture effect. One way to improve the resolution of a display is to use a pixel arrangement structure that takes advantage of the assimilation or the Von Bezold color mixture effect.

One such structure, in which first sub-pixels and second sub-pixels that emit light components of different colors are alternately arranged in the same column, may be adopted. In the organic light emitting display having such a structure, the first sub-pixels and the second sub-pixels that are arranged in the same column share one data line and a data driver alternately supplies data of a first color and data of a second color to the one data line.

In order to effectively mass produce such organic light emitting displays, a sheet unit production method is used, where a plurality of organic light emitting display panels are formed on one mother substrate and then scribed into individual panels. In order to improve test efficiency with the sheet unit production method, a sheet unit test method is used, where the plurality of organic light emitting display panels are concurrently tested on the mother substrate before scribing. In the sheet unit test, power and test signals are supplied to the plurality of organic light emitting display panels through sheet wiring lines formed on the mother substrate.

One such way to drive the common data line for pixels of the first and second colors during the sheet unit test on such organic light emitting display panels is to use a pulse-shaped alternating current (AC) signal supplied to at least one of the sheet wiring lines. This AC signal would alternately supply a test signal (test data) of the first color and a test signal of the second color to the common data line. However, since the sheet wiring lines for coupling the plurality of organic light emitting display panels are longitudinally formed on the mother substrate, they have to be of sufficient length to reach all of the organic light emitting display panels in a row or column. As a result, due to the distortion of wavelengths of the pulse-shaped AC signals, which is caused by voltage drop (IR drop) and signal delay (RC delay), the sheet unit test and an aging process may not be effectively performed.

FIG. 1 is a schematic plan view illustrating a mother substrate of an organic light emitting display according to an embodiment of the present invention configured for effectively performing the above tests. Referring to FIG. 1, the mother substrate 100 of the organic light emitting display according to an embodiment of the present invention includes a plurality of organic light emitting display panels 110 arranged in a matrix and a first wiring line group 120 and a second wiring line group 130 formed in the external region of the panels 110 in a first (column) direction and a second (row) direction, respectively, the first direction crossing the second direction.

Each of the panels 110 includes a scan driver 140 for generating scan signals in accordance with the scan driving power and the scan control signals supplied from the outside and for sequentially supplying the scan signals to scan lines, a display unit 150 including first sub-pixels, second sub-pixels, and third sub-pixels provided at crossing regions of data lines and the scan lines to emit light components of different colors, a switch unit 160 coupled to one end of the data lines, a test circuit unit 170 coupled to the other end of the data lines, and a pad unit 180 including a plurality of pads P for transmitting the power and/or the signals supplied from the outside to the inside of the panel 110.

The first wiring line group 120 is formed in an external region of the organic light emitting display panels 110, for example, in a boundary region between the panels 110 in the first direction (vertical direction). The first wiring line group 120 includes, for example, a plurality of wiring lines for transmitting the test power or the signals supplied from the outside through test pads TP to the plurality of panels 110 provided in the same column.

For example, the first wiring group 120 includes a first wiring line 121 for receiving a first pixel power ELVDD from the outside and for transmitting the received first pixel power ELVDD to the plurality of panels 110, and a second wiring line 122 for receiving scan driving power VDD and VSS and scan control signals SCS from the outside and for transmitting the received scan driving power VDD and VSS and scan control signals SCS to the plurality of panels 110.

Here, the second wiring line 122 is illustrated as one wiring line; however, it may include a plurality of wiring lines. For example, the second wiring line 122 may include five wiring lines that receive a first scan driving power VDD, a second scan driving power VSS, a start pulse SP, a scan clock signal CLK, and an output enable signal OE, respectively.

The first wiring line group 120 is commonly coupled to the panels 110 provided in the same column to transmit the test power and/or the signals supplied thereto during a sheet unit test, to the panels 110 coupled thereto.

The second wiring line group 130 is formed in the external region of the panels 110 of the organic light emitting display, for example, in a boundary region between the panels 110 in the second direction (horizontal direction) that crosses the first direction. The second wiring line group 130 includes a plurality of wiring lines for transmitting the test power or the signals supplied from the outside through the test pads TP to the plurality of panels 110 provided in the same row.

For example, the second wiring line group 130 includes a third wiring line 131 for receiving a second pixel power ELVSS from the outside and for transmitting the received second pixel power ELVSS to the plurality of panels 110, a fourth wiring line 132 for receiving test control signals and test signals for a sheet unit test from the outside and for transmitting the received test control signals and test signals to the plurality of panels 110, and a fifth wiring line 133 for receiving control signals for controlling the switch unit 160 from the outside and for transmitting the received control signals to the plurality of panels 110.

Here, the fourth wiring line 132 is illustrated as one wiring line, however, may include a plurality of wiring lines. For example, the fourth wiring line 132 may include four wiring lines that receive a test control signal, a red test signal, a blue test signal, and a green test signal, respectively. In another embodiment, separate test control signals for each of the three colors may be provided.

The second wiring line group 130 is commonly coupled to the panels 110 provided in the same row to transmit the test power and/or the signals supplied thereto during the sheet unit test, to the panels 110 coupled thereto.

In the above-described mother substrate 100 of the organic light emitting display, the sheet unit test may be performed on the plurality of panels 110 in the sheet configuration in which the panels 110 are not scribed. Here, the sheet unit test may include a lighting test, a leakage current test, and/or an aging process test of the panels 110. The sheet unit test is performed as an array test on the plurality of panels 110 that make up the mother substrate 100, to improve the efficiency of testing the individual panels.

The sheet unit test may be performed by supplying the test signals to the data lines through the test circuit unit 170 while the switch unit 160 maintains a turn-off state. Here, the test signals refer to signals for performing the lighting test, the leakage current test, and the aging process test. The processes of the sheet unit test will be described in detail later.

In the above-described mother substrate 100 of the organic light emitting display according to an embodiment of the present invention, the power and the signals for the sheet unit test are supplied once to the plurality of panels 110 on the mother substrate 100 through the first and second wiring line groups 120 and 130 to reduce test time and test cost and to improve the efficiency of the test. Furthermore, even if the circuit wiring lines that constitute the panel 110 change or the size of the panel 110 changes, when the circuit wiring lines of the first and second wiring line groups 120 and 130 and the size of the mother substrate 100 do not change, the test may be performed without changing a test apparatus or jig.

The panels 110, on which the sheet unit test is performed, are scribed from the mother substrate 100 along scribing lines 101 to separate into the individual panels 110. In this embodiment, the electric coupling points (for example, test pads TP) for the panels 110 and the first and second wiring line groups 120 and 130 are provided outside of the scribing lines 101 of the panels 110 and coupled to the panels 110 through the pad units 180. After the panels 110 are separated from the mother substrate 100, the first and second wiring line groups 120 and 130 are electrically insulated from the other components that constitute the panel 110, for example, the scan driver 140, the display unit 150, the switch unit 160, and the test circuit unit 170, and do not affect the driving of the panel.

According to the present embodiment, the display unit 150 provided in each of the panels 110 includes first sub-pixels, second sub-pixels, and third sub-pixels that emit light components of different colors. The first and second sub-pixels are alternately arranged in the same columns and the third sub-pixels are arranged in the columns adjacent to the columns where the first and second sub-pixels are arranged in a line. The data lines of the first sub-pixels are separated from the data lines of the second sub-pixels in the columns where the first and second sub-pixels are arranged. In this way, the sheet unit test can be effectively performed while adopting the pixel arrangement structure that displays an image of high resolution, which will be described in detail with reference to FIG. 2.

Figure 2:
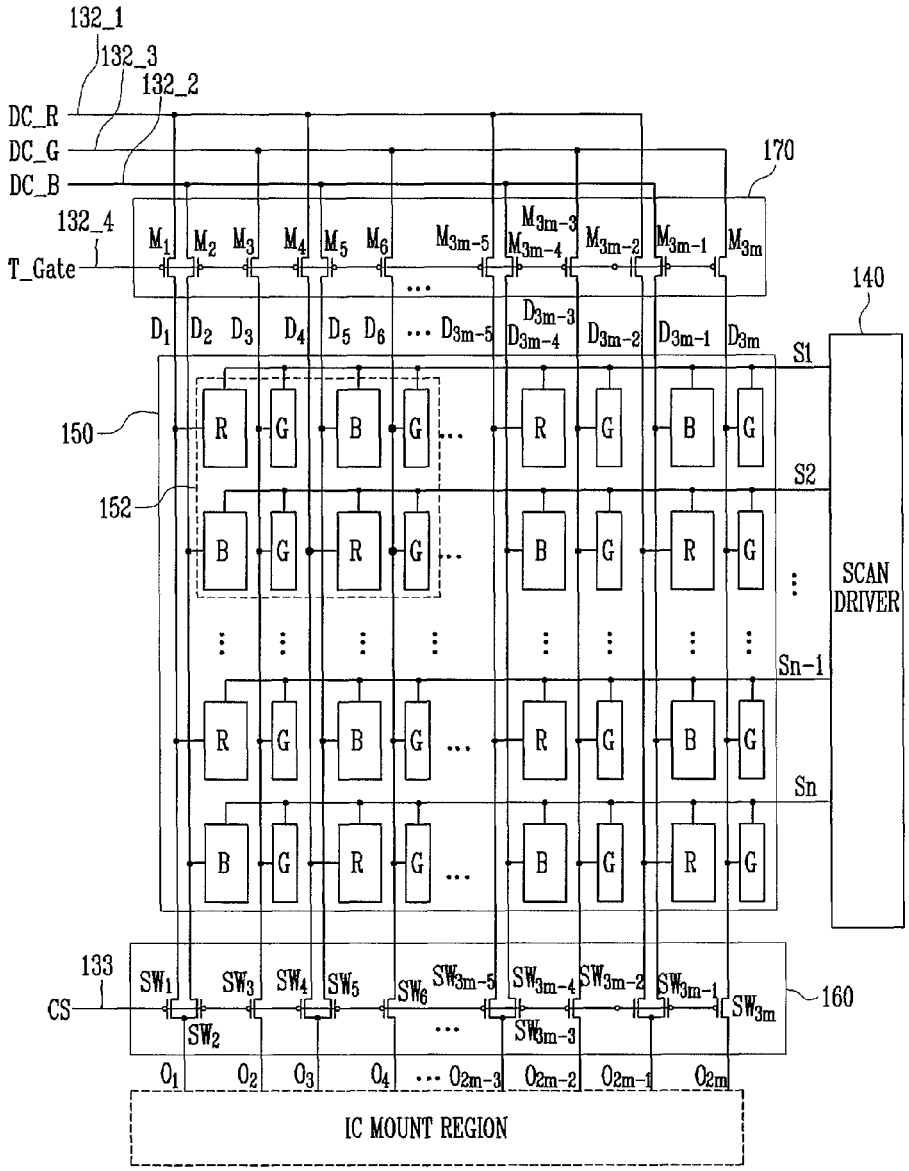
FIG. 2 is a schematic plan view illustrating an example of a display unit, a switch unit, and a test circuit unit of FIG. 1.

FIG. 2 is a schematic plan view illustrating an example of the display unit 150, the switch unit 160, and the test circuit unit 170 of FIG. 1. Referring to FIG. 2, the display unit 150 includes first sub-pixels R, second sub-pixels B, and third sub-pixels G that emit light components of different colors so that a uniform pattern in units of sub-pixel groups 152 including two first sub-pixels R, two second sub-pixels B, and four third sub-pixels G is repeatedly provided in the display unit 150.

In particular, the first sub-pixels R and the second sub-pixels B are alternately arranged in the same column and the third sub-pixels G are arranged in the column adjacent to the column where the first sub-pixels R and the second sub-pixels B are arranged in a line.

Here, the first sub-pixels R may be set as the red sub-pixels that emit red light, the second sub-pixels B may be set as the blue sub-pixels that emit blue light, and the third sub-pixels G may be set as the green sub-pixels that emit green light.

In this embodiment, the first sub-pixels R and the second sub-pixels B are diagonally provided based on the shared columns. That is, the pixel pattern not only alternates between R and B in the column direction of the shared columns, it also alternates between R and B in the row direction across the shared columns, thus forming a checkerboard layout of the R and B pixels in every other pixel column (the shared columns). In the remainder of the display unit 150, the third sub-pixels G are arranged in a conventional layout in non-shared columns that are adjacent to the R and B shared columns. That is, there is one G pixel adjacent to each R pixel and one G pixel adjacent to each B pixel in the columns adjacent to each of the R and B shared columns.

The third sub-pixels G may have a smaller width than the first sub-pixels R and the second sub-pixels B in a horizontal axis because the third sub-pixels G may be twice as numerous as each of the first sub-pixels R and the second sub-pixels B. That is, in the display unit 150, each of the first sub-pixels R and the second sub-pixels B may provide a quarter of the resolution of the display unit 150 and the third sub-pixels G may provide half of the resolution of the display unit 150.

For example, the third sub-pixels G may have a width half of the width of each of the first sub-pixels R and the second sub-pixels B in the horizontal axis. To lay this out on the display panel and provide an equivalent amount of pixel area to each color, the third sub-pixels G may have a "separated" form, in which the third sub-pixels G are twice as numerous, but only half as wide, as the first sub-pixels R and the second sub-pixels B. The third sub-pixels G in the "separated" form may be set as sub-pixels of a color that is more sensitive to the resolution of the display panel, for example, the green sub-pixels, so that a high quality image can be displayed.

The arrangement of the first sub-pixels R, the second sub-pixels B, and the third sub-pixels G in the sub-pixel group 152 will be described in detail. The sub-pixel group 152 includes two first sub-pixels R, two second sub-pixels B, and four third sub-pixels G that are arranged in two continuous rows and in four continuous columns. In adjacent rows, one first sub-pixel R and one second sub-pixel B are sequentially arranged in a first column and two separated third sub-pixels G are sequentially arranged in a second column adjacent to the first column. In a third column adjacent to the second column, one second sub-pixel B and one first sub-pixel R are sequentially arranged. In a fourth column adjacent to the third column, two third sub-pixels G are sequentially arranged.

When the above-described pixel arrangement structure is adopted, an image of high resolution can be displayed in comparison with the number of sub-pixels R, G, and B provided in the display unit 150 by a "sub-pixel rendering method." That is, in the above-described pixel arrangement, the separated third sub-pixels G provide half the resolution of the display unit. Further, the first sub-pixels R and the second sub-pixels B each provide one quarter of the resolution of the display unit.

On the other hand, according to the present embodiment, the area of one first sub-pixel R or one second sub-pixel B is, for instance, twice as large as the area of one separated third sub-pixel G. However, the present invention is not limited to the above. That is, the areas of the first sub-pixel R, the second sub-pixel B, and the third sub-pixel G may change in consideration, for example, of the life of a material.

According to the present embodiment, the first sub-pixels R and the second sub-pixels B provided in the same column do not share a same data line. Data lines of the first sub-pixels R and data lines of the second sub-pixels B are separated from each other and repeat in units of columns. That is, in the shared columns where the first sub-pixels R and the second sub-pixels B are arranged, first data lines D1, D4, . . . , and D3*m*−2 coupled to the first sub-pixels R in the same columns are separated from second data lines D2, D5, . . . , and D3*m*−1 coupled to the second sub-pixels B in the same columns.

Further, in the non-shared columns where the third sub-pixels G are arranged, third data lines D3, D6, . . . , and D3*m* are coupled to the third sub-pixels G.

One end of each of the data lines D1 to D3*m* is coupled to the switch unit 160 and the other end of each of the data lines D1 to D3*m* is coupled to the test circuit unit 170.

The switch unit 160 includes first switches SW1, SW4, . . . , and SW3*m*−2 corresponding to the first sub-pixels R and coupled between the first data lines D1, D4, . . . , and D3*m*−2 and output lines O1, O3, . . . , and O2*m*−1 in the corresponding shared columns among output lines O1 to O2*m* of the data driver to be mounted in an integrated circuit (IC) mount region. In addition, the switch unit 160 includes second switches SW2, SW5, . . . , and SW3*m*−1 corresponding to the second sub-pixels B and coupled between the second data lines D2, D5, . . . , and D3*m*−1 and the output lines O1, O3, . . . , and O2*m*−1 in the corresponding shared columns among the output lines O1 to O2*m* of the data driver to be mounted in the IC mount region. Further, the switch unit 160 includes third switches SW3, SW6, . . . , and SW3*m* corresponding to the third sub-pixels G and coupled between the third data lines D3, D6, . . . , and D3*m* and output lines O2, O4, . . . , and O2*m* in the corresponding non-shared columns among the output lines O1 to O2*m* of the data driver to be mounted in the IC mount region.

The first and second switches SW1, SW2, SW4, SW5, . . . , SW3*m*−2, and SW3*m*−1 couple each of the pairs of first and second data lines D1, D2, D4, D5, . . . , D3*m*−2, and D3*m*−1 to the respective output lines O1, O3, . . . , and O2*m*−1 of the data driver in units of columns. That is, one electrode of each of the first and second switches coupled to the corresponding data lines of the first and second sub-pixels R and B provided in the same column is coupled to the same output line of the data driver. The third switches SW3, SW6, . . . , and SW3*m* couple the third data lines D3, D6, and D3*m* to the other output lines O2, O4, . . . , and O2*m* of the data driver.

Here, the gate electrodes of the first to third switches SW1 to SW3*m* are commonly coupled to the same wiring line among the wiring lines included in the first or second wiring line group 120 or 130. For example, the gate electrodes of the first to third switches SW1 to SW3*m* may be commonly coupled to the fifth wiring line 133 included in the second wiring line group 130. The switch unit 160 receives a control signal CS that maintains the turn-off state of the first to third switches SW1 to SW3*m* from the fifth wiring line 133 while the sheet unit test is performed and maintains a turn-off state. On the other hand, the switch unit 160 transmits the data signals supplied from the output lines O1 to O2*m* of the data driver to the data lines D1 to D3*m* while maintaining a turn-on state in response to another control signal supplied through the pad unit 180 in the driving period of the organic light emitting display after the sheet unit test is completed and the panels 110 are separated.

The test circuit unit 170 includes a plurality of transistors M1 to M3*m* coupled to the other ends of the data lines D1 to D3*m*. In detail, the test circuit unit 170 includes first transistors M1, M4, . . . , and M3*m*−2 coupled between the first data lines D1, D4, . . . , and D3*m*−2 and first signal line 132_1 included in the first or second wiring line group 120 or 130, second transistors M2, M5, . . . , and M3*m*−1 coupled between the second data lines D2, D5, . . . , and D3*m*−1 and second signal line 132_2 included in the first or second wiring line group 120 or 130, and third transistors M3, M6, . . . , and M3*m* coupled between the third data lines D3, D6, . . . , and D3*m* and third signal line 132_3 included in the first or second wiring line group 120 or 130.

That is, although the first data lines D1, D4, . . . , and D3*m*−2 and the corresponding second data lines D2, D5, . . . , and D3*m*−1 drive pixels in the same (shared) columns, the first data lines D1, D4, . . . , and D3*m*−2 are coupled to a different signal line (that is, one configured to drive the first sub-pixels R) included in the first or second wiring line group 120 or 130 and by different transistors included in the test circuit unit 170 than those of the second data lines D2, D5, . . . , and D3*m*−1, which are coupled to a signal line of the first or second wiring group 120 or 130 that is configured to drive the second sub-pixels B.

Here, the first signal line 132_1, the second signal line 132_2, and the third signal line 132_3 are included in the first or second wiring line group 120 or 130. For example, the first signal line 132_1, the second signal line 132_2, and the third signal line 132_3 may be included in the fourth wiring line 132 included in the second wiring line group 130. The first signal line 132_1, the second signal line 132_2, and the third signal line 132_3 receive the red test signal DC_R, the blue test signal DC_B, and the green test signal DC_G, respectively, in the form of direct current (DC) while the sheet unit test is performed. The red test signal DC_R, the blue test signal DC_B, and the green test signal DC_G supplied to the first signal line 132_1, the second signal line 132_2, and the third signal line 132_3, respectively, are supplied to the data lines D1 to D3*m* through the test circuit unit 170.

On the other hand, the gate electrodes of the first to third transistors M1 to M3*m* are commonly coupled to the same control line 132_4 included in the first or second wiring line group 120 or 130. For example, the gate electrodes of the first to third transistors M1 to M3*m* are commonly coupled to the control line 132_4 included in the fourth wiring line 132 of the second wiring line group 130 to receive a test control signal T_Gate. The DC test control signal T_Gate that maintains the turn-on state of the first to third transistors M1 to M3*m* is supplied to the control line 132_4 while the sheet unit test is performed. In addition, the first to third transistors M1 to M3*m* supply the red test signal DC_R, the blue test signal DC_B, and the green test signal DC_G supplied from the first to third signal lines 132_1, 132_2, and 132_3 to the first data lines D1, D4, . . . , and D3*m*−2, the second data lines D2, D5, . . . , and D3*m*−1, and the third data lines D3, D6, . . . , and D3*m* while maintaining a turn-on state while the sheet unit test is performed.

The processes of the sheet unit test using the test circuit unit 170 will be described in detail. First, when the test control signal T_Gate for turning on the test circuit unit 170 is supplied from the control line 132_4, the transistors M1 to M3*m* included in the test circuit unit 170 are concurrently turned on. Therefore, the red test signal DC_R, the blue test signal DC_B, and the green test signal DC_G supplied from the first to third signal lines 132_1 to 132_3 are respectively supplied to the first data lines D1, D4, . . . , and D3*m*−2, the second data lines D2, D5, . . . , and D3*m*−1, and the third data lines D3, D6, . . . , and D3*m*.

While the sheet unit test is performed on the plurality of panels 110 on the mother substrate 100, the test circuit unit 170 receives the DC test signals and test control signal from the plurality of wiring lines (for example, the first to third signal lines 132_1, 132_2, and 132_3 and the control line 132_4) included in the first or second wiring line group 120 or 130 and supplies the test signals to the data lines D1 to D3*m* in response to the test control signal.

On the other hand, the scan control signals such as the first scan driving power VDD, the second scan driving power VSS, and the scan control signals SCS are supplied from the second wiring line 122 of the first wiring line group 120 to the scan driver 140. Then, the scan driver 140 sequentially generates the scan signals and supplies the generated scan signals to the display unit 150. Therefore, the pixels that receive the scan signals and the test signals emit light and display an image so that the sheet unit test such as the lighting test is performed.

As described above, according to the present embodiment, each of the data lines D1, D4, . . . , and D3*m*−2 of the first sub-pixels R and the data lines D2, D5, . . . , and D3*m*−1 of the second sub-pixels B are separated from each other. In addition, the first sub-pixels R and the second sub-pixels B are alternately arranged in the same columns so that the test signals and the test control signal can be supplied in DC form. Therefore, the distortion of waveforms, which is caused by voltage drop (IR Drop) or signal delay (RC Delay), is prevented during the sheet unit test. Therefore, the brightness and chromatic coordinates of the panels 110 are made substantially uniform so that the sheet unit test and the aging process test can be effectively performed.

On the other hand, after the sheet unit test is completed and the panels 110 are separated, a bias signal that maintains the turn-off state of the first to third transistors M1 to M3*m* is supplied to the control line 132_4 through the pad unit 180. That is, after the sheet unit test is completed, the test circuit unit 170 remains as a transistor group that maintains a turn-off state.

Figure 3:
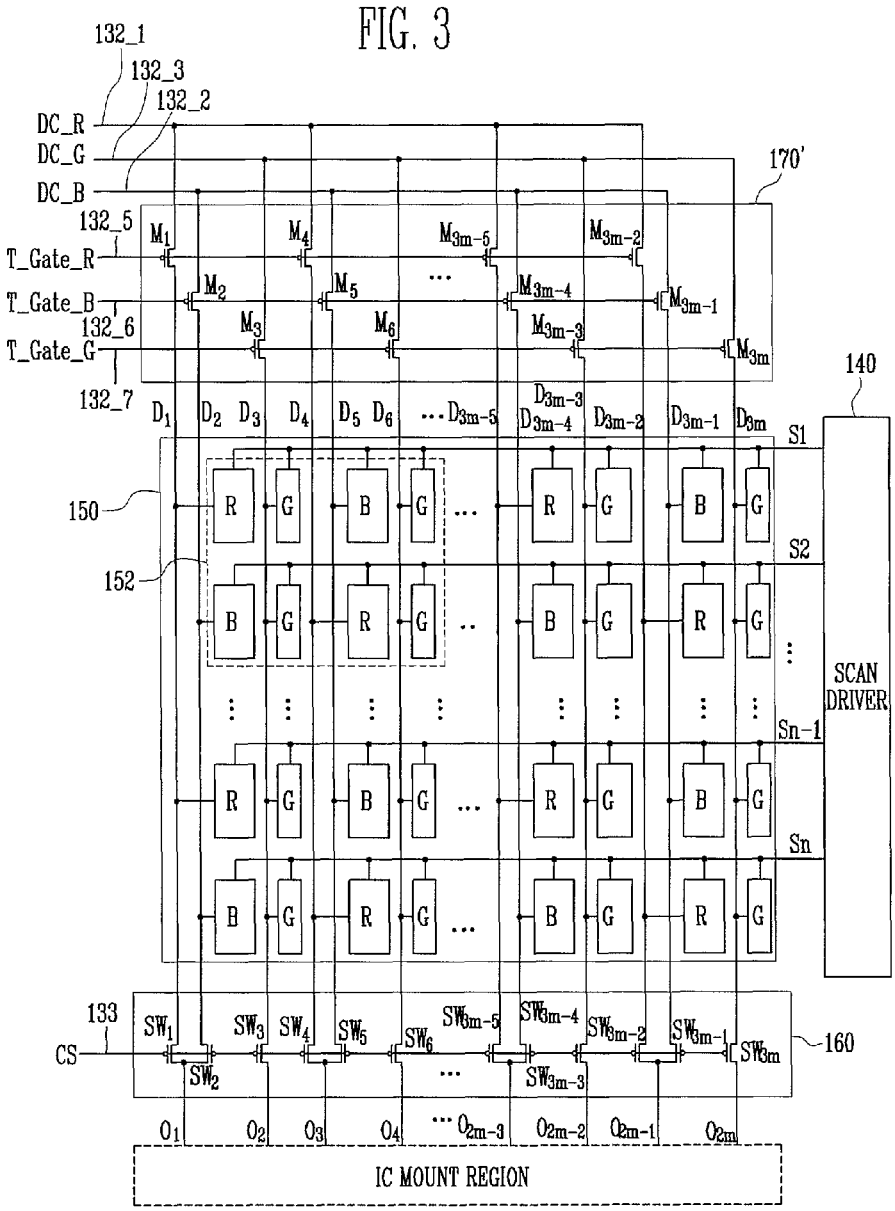
FIG. 3 is a schematic plan view illustrating another example of the test circuit unit.

FIG. 3 is a schematic plan view illustrating another example of the test circuit unit. For the sake of conciseness, when FIG. 3 is described, description of the elements similar to or the same as the elements of FIG. 2 may be omitted.

Referring to FIG. 3, the gate electrodes of the first transistors M1, M4, . . . , and M3*m*−2 provided in a test circuit unit 170' are commonly coupled to a first control line 132_5 included in the first or second wiring line group 120 and 130, the gate electrodes of the second transistors M2, M5, . . . , and M3*m*−1 are commonly coupled to a second control line 132_6 included in the first or second wiring line group 120 or 130, and the gate electrodes of the third transistors M3, M6, . . . , and M3*m* are commonly coupled to a third control line 132_7 included in the first or second wiring group 120 or 130.

The test control signals T_Gate_R, T_Gate_B, and T_Gate_G that maintain the turn-on state of the first to third transistors M1 to M3*m* while the sheet unit test is performed on the plurality of panels 110 are supplied to the first to third control lines 132_5, 132_6, and 132_7. Then, the first to third transistors M1 to M3*m* transmit the test signals DC_R, DC_B, and DC_G supplied from the first to third signal lines 132_1, 132_2, and 132_3 to the data lines D1 to D3*m*.

As described above, when the gate electrodes of the first transistors M1, M4, . . . , and M3*m*−2 are coupled to the first control line 132_5, the second transistors M2, M5, . . . , and M3*m*−1 are coupled to the second control line 132_6, and the third transistors M3, M6, . . . , and M3*m* are coupled to the third control line 132_7, more degrees of freedom of test signal design can be obtained during the sheet test period. For example, each of the test signals (one per color) can be separately disabled from being transmitted to the pixels of their corresponding color.

After the panels 110 are separated, bias signals that maintain the turn-off state of the first to third transistors M1 to M3*m* are supplied to the first to third control lines 132_5, 132_6, and 132_7. That is, after the sheet unit test is completed, the test circuit unit 170' remains as a transistor group while maintaining a turn-off state.

Figure 4:
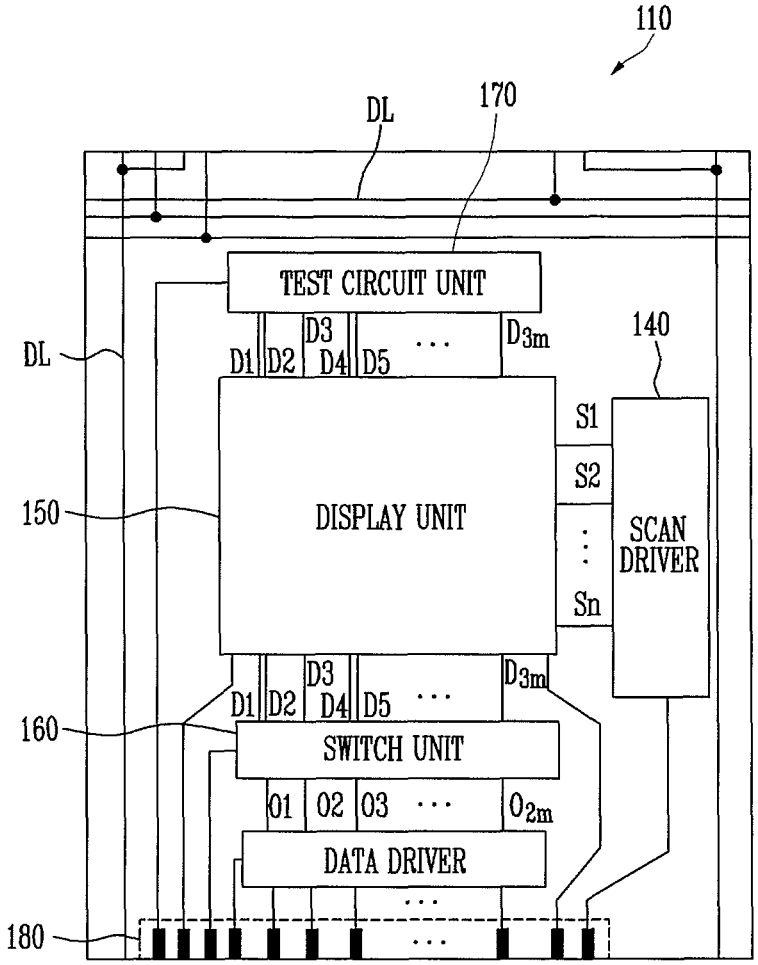
FIG. 4 is a schematic plan view illustrating an organic light emitting display panel separated from the mother substrate of FIG. 1.

FIG. 4 is a schematic plan view illustrating an organic light emitting display panel separated from the mother substrate of FIG. 1. When FIG. 4 is described, description redundant to FIGS. 1 to 3 will be omitted.

Referring to FIG. 4, in the external dummy region of the organic light emitting display panel 110 separated from the mother substrate, one region of each of the sheet wiring lines formed in a first direction or in a second direction that crosses the first direction (the wiring lines of the first or second wiring line group) is cut off so that one or more floating dummy wiring lines DL are left.

In addition, the data driver is mounted in the IC mount region and the output lines O1 to O2*m* of the data driver are coupled to the first and second data lines D1, D2, D4, D5, . . . , D3*m*−2, and D3*m*−1 or the third data lines D3, D6, . . . , and D3*m* through the switch unit 160 in units of columns.

The first and second data lines D1, D2, D4, D5, . . . , D3*m*−2, and D3*m*−1 that drive pixels in the same columns are coupled to the same corresponding output lines among the output lines O1 to O2*m* of the data driver by the switch unit 160 to receive the data signals from the data driver. The data driver alternately supplies the data signals of the first sub-pixels R and the data signals of the second sub-pixels B to the output lines coupled to the first and second data lines D1, D2, D4, D5, . . . , D3*m*−2, and D3*m*−1. Once the scribing of the panels 110 is completed, the test circuit unit 170 maintains a turn-off state by the bias signal supplied through the pad unit 180.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display, comprising:

a display unit comprising sub-pixels arranged in columns, the sub-pixels comprising first sub-pixels, second sub-pixels, and third sub-pixels for emitting light corresponding to different colors and that are located at crossing regions of scan lines and data lines, the columns comprising a first column, a second column adjacent to the first column, a third column adjacent to the second column, and a fourth column adjacent to the third column, the first and third columns comprising the first and second sub-pixels, the second and fourth columns comprising the third sub-pixels, the data lines comprising first and fourth data lines respectively coupled to every other one of the sub-pixels in the first and third columns, second and fifth data lines respectively coupled to every other one of the sub-pixels in the first and third columns, and third and sixth data lines respectively coupled to every one of the sub-pixels in the second and fourth columns;

a scan driver for supplying scan signals to the scan lines;

a data driver coupled to one end of each of the data lines, for supplying data signals to the data lines;

a switch unit coupled between the one end of each of the data lines and the data driver to transmit the data signals supplied from output lines of the data driver to the data lines, the output lines comprising a first output line coupled by the switch unit to the first and second data lines, a second output line coupled by the switch unit to the third data line, a third output line coupled by the switch unit to the fourth and fifth data lines, and a fourth output line coupled by the switch unit to the sixth data line; and a test circuit unit comprising a plurality of transistors coupled to other ends of the data lines, the transistors comprising first to sixth transistors respectively coupled to the first to sixth data lines.

2. The organic light emitting display as claimed in claim 1, wherein the switch unit comprises first and second switches for respectively coupling the first output line to the first and second data lines, a third switch for coupling the second output line to the third data line, fourth and fifth switches for respectively coupling the third output line to the fourth and fifth data lines, and a sixth switch for coupling the fourth output line to the sixth data line.

3. The organic light emitting display as claimed in claim 2, wherein the first to sixth switches of the switch unit are configured to maintain a turn-on state in a period in which the organic light emitting display is driven.

4. The organic light emitting display as claimed in claim 1, wherein the data driver is configured to supply first ones of the data signals to the first output line, and wherein the data driver is further configured to supply every other one of the first ones of the data signals to one of the first sub-pixels and to supply every other one of the first ones of the data signals to one of the second sub-pixels.

5. The organic light emitting display as claimed in claim 1, wherein the first and fourth transistors are respectively coupled between the first and fourth data lines and a first signal line, the second and fifth transistors are respectively coupled between the second and fifth data lines and a second signal line, and the third and sixth transistors are respectively coupled between the third and sixth data lines and a third signal line.

6. The organic light emitting display as claimed in claim 5, wherein gate electrodes of the first to sixth transistors are commonly coupled to a control line so that a bias signal that is supplied to the control line is configured to maintain a turn-off state of the first to sixth transistors.

7. The organic light emitting display as claimed in claim 5, wherein gate electrodes of the first and fourth transistors are commonly coupled to a first control line, wherein gate electrodes of the second and fifth transistors are commonly coupled to a second control line, wherein gate electrodes of the third and sixth transistors are commonly coupled to a third control line, and wherein bias signals that are supplied to the first, second, and third control lines are configured to maintain a turn-off state of the first to sixth transistors.

8. The organic light emitting display as claimed in claim 1, wherein the first sub-pixels and the second sub-pixels are alternately arranged in a row direction among the first and third columns.

9. The organic light emitting display as claimed in claim 1, wherein the third sub-pixels have a smaller width than a width of the first sub-pixels and the second sub-pixels in a row direction, and the third sub-pixels are twice as numerous as each of the first sub-pixels and the second sub-pixels.

10. The organic light emitting display as claimed in claim 1, wherein the first, second, and third sub-pixels are arranged in a uniform pattern made up of a sub-pixel group comprising two of the first sub-pixels, two of the second sub-pixels, and four of the third sub-pixels arranged in contiguous groups corresponding to two rows and the first to fourth columns, wherein the sub-pixel group comprises:

one of the first sub-pixels and one of the second sub-pixels sequentially arranged in the first column;

two of the third sub-pixels sequentially arranged in the second column;

one of the second sub-pixels and one of the first sub-pixels sequentially arranged in the third column; and two of the third sub-pixels sequentially arranged in the fourth column.

11. The organic light emitting display as claimed in claim 10, wherein the third sub-pixels have a width that is half of a width of the first sub-pixels and the second sub-pixels in a row direction.

12. The organic light emitting display as claimed in claim 1, wherein the first sub-pixels and the second sub-pixels are red sub-pixels and blue sub-pixels, respectively, and the third sub-pixels are green sub-pixels.

13. The organic light emitting display as claimed in claim 1, further comprising at least one dummy wiring line in an external dummy region in a first direction or in a second direction that crosses the first direction and having its end floated.

14. The organic light emitting display as claimed in claim 1, wherein, in the display unit, each of the first sub-pixels and the second sub-pixels provide one quarter of a resolution of the display and the third sub-pixels provide one half of the resolution of the display.

15. A mother substrate comprising: a plurality of organic light emitting display panels arranged in a matrix; a first wiring line group comprising a plurality of wiring lines at a region external to the organic light emitting display panels in a first direction, for transmitting test power or external signals to ones of the plurality of organic light emitting display panels in a same panel column; and a second wiring line group comprising a plurality of wiring lines at a region external to the organic light emitting display panels in a second direction that crosses the first direction, for transmitting other test power or external signals to ones of the plurality of organic light emitting display panels in a same panel row, wherein each of the organic light emitting display panels comprises:

a display unit comprising sub-pixels arranged in columns, the sub-pixels comprising first sub-pixels, second sub-pixels, and third sub-pixels for emitting light corresponding to different colors and that are located at crossing regions of scan lines and data lines, the columns comprising a first column, a second column adjacent to the first column, a third column adjacent to the second column, and a fourth column adjacent to the third column, the first and third columns comprising the first and second sub-pixels, the second and fourth columns comprising the third sub-pixels, the data lines comprising first and fourth data lines respectively coupled to every other one of the first sub-pixels in the shared first and third columns and second and fifth data lines coupled to every other one of the sub-pixels in the first and third columns and third and sixth data lines respectively coupled to every one of the sub-pixels in the second and fourth columns;

a scan driver for supplying scan signals to the scan lines;

a switch unit comprising a plurality of switches coupled to one end of each of the data lines;

output lines comprising a first output line coupled by the switch unit to the first and second data lines, a second output line coupled by the switch unit to the third data line, a third output line coupled by the switch unit to the fourth and fifth data lines, and a fourth output line coupled by the switch unit to the sixth data line; and a test circuit unit comprising a plurality of transistors coupled to other ends of the data lines, the transistors comprising first to sixth transistors respectively coupled to the first to sixth data lines, wherein the first and fourth data lines are respectively coupled by the first and fourth transistors to a first signal line included in the first wiring line group or the second wiring line group, and the second and fifth data lines are respectively coupled by the second and fifth transistors to a second signal line included in the first wiring line group or the second wiring line group.

16. The mother substrate as claimed in claim 15, wherein the first and fourth transistors are respectively coupled between the first and fourth data lines and the first signal line, the second and fifth transistors are respectively coupled between the second and fifth data lines and the second signal line, and the third and sixth transistors are respectively coupled between the third and sixth data lines and a third signal line included in the first or second wiring line group.

17. The mother substrate as claimed in claim 16, wherein gate electrodes of the first to sixth transistors are commonly coupled to a control line included in the first or second wiring line group so that a test control signal that is supplied to the control line is configured to maintain a turn-on state of the first to sixth transistors while a test is performed on the organic light emitting display panels.

18. The mother substrate as claimed in claim 16, wherein gate electrodes of the first and fourth transistors are commonly coupled to a first control line included in the first or second wiring line group, wherein gate electrodes of the second and fifth transistors are commonly coupled to a second control line included in the first or second wiring line group, wherein gate electrodes of the third and sixth transistors are commonly coupled to a third control line included in the first or second wiring line group, and wherein, while a test is performed on the organic light emitting display panels, test control signals that are supplied to the first, second, and third control lines are configured to maintain a turn-on state of the first to sixth transistors.

19. The mother substrate as claimed in claim 15, wherein the test circuit unit is configured to receive direct current (DC) test signals and a test control signal from the plurality of wiring lines included in the first or second wiring line group while a test is performed on the organic light emitting display panels, and to supply the test signals to the data lines in response to the test control signal.

20. The mother substrate as claimed in claim 15, wherein the switch unit is configured to maintain a turn-off state by a control signal supplied from the first or second wiring line group while a test is performed on the organic light emitting display panels.

* * * * *